US006407050B1

(12) United States Patent
Huish et al.

(10) Patent No.: US 6,407,050 B1
(45) Date of Patent: Jun. 18, 2002

(54) α-SULFOFATTY ACID METHYL ESTER LAUNDRY DETERGENT COMPOSITION WITH REDUCED BUILDER DEPOSITS

(75) Inventors: Paul Danton Huish, Salt Lake City; Laurie Jensen, Midvale, both of UT (US)

(73) Assignee: Huish Detergents, Inc., Salt Lake City, UT (US)

( * ) Notice: Subject to any disclaimer, the term of this patent is extended or adjusted under 35 U.S.C. 154(b) by 0 days.

(21) Appl. No.: 09/481,815

(22) Filed: Jan. 11, 2000

(51) Int. Cl.[7] ..... C11D 17/00

(52) U.S. Cl. ..... 510/357; 510/424; 510/426; 510/428; 510/446; 510/447; 510/450

(58) Field of Search ..... 510/424, 426, 510/428, 357, 440, 446, 447, 450, 383, 425; 560/147

(56) References Cited

U.S. PATENT DOCUMENTS

| | | | |
|---|---|---|---|
| 3,962,107 | A | 6/1976 | Levin |
| 3,997,567 | A | 12/1976 | Oghoshi |
| 4,019,999 | A | 4/1977 | Ohren |
| 4,040,988 | A | 8/1977 | Benson |
| 4,056,481 | A | 11/1977 | Tate |
| 4,064,062 | A | 12/1977 | Yurko |
| 4,438,025 | A | 3/1984 | Satsuki |
| 4,705,644 | A | 11/1987 | Barone |
| 4,919,845 | A | 4/1990 | Vogt |
| 4,935,159 | A | 6/1990 | Schenker |
| 5,026,400 | A | 6/1991 | Holland |
| 5,324,649 | A | 6/1994 | Arnold |
| 5,382,677 | A | 1/1995 | Colignon |
| 5,391,783 | A | 2/1995 | Colignon |
| 5,397,494 | A | 3/1995 | Vega |
| 5,429,773 | A | 7/1995 | Sherry |
| 5,475,134 | A | 12/1995 | Baker |
| 5,616,781 | A | 4/1997 | Sajic |
| 5,637,758 | A | 6/1997 | Sakic |
| 5,688,982 | A | 11/1997 | Kahn |
| 5,691,296 | A | 11/1997 | Agar |
| 5,900,399 | A | 5/1999 | Seiter |
| 5,919,747 | A | 7/1999 | Kazuta |
| 5,945,394 | A | 8/1999 | Sajic |
| 5,955,418 | A | 9/1999 | Kazuta |
| 5,961,662 | A | 10/1999 | Yamaguchi |
| 5,972,861 | A | 10/1999 | Rolfes |
| 5,980,580 | A | 11/1999 | Yamaguchi |
| 6,057,280 | A | 5/2000 | Huish |

FOREIGN PATENT DOCUMENTS

| | | |
|---|---|---|
| EP | 0 336 740 B1 | 10/1989 |

OTHER PUBLICATIONS

Foster, Norman C., Hovda, Kieth D., Manufacture of Methyl Ester Sulfonates and Other Derivatives. Chemithon. 1997 Seattle, WA. http/www.chemithon.com/press.html.

Hovda K., The Challenge of Mehylester Sulfonation. Chemithon. 1997 Seattle WA. http/www.chemithon.com/press.html.

MacArthur, Brian W., Brooks, Burt, Sheats, Brad W., Foster, Norman C., Ph.D., Meeting the Challenge of Methylester Sulfonation. Chemithon. 1998 Seattle WA. http/www.chemithon.com/press.html.

Foster, Norman C., Ph.D., P.E., Sulfonation and Sufation Processes. Chemithon. 1997 Seattle WA. http/www.chemithon.com/press.html.

Hovda, Kieth Methyl Ester Sulfonation: Process Optimization. Chemithon. Seattle WA. http/www.chemithon.com/press.html.

Foster, Norman C., Ph.D., P.E., Rollock, Michael, BS ChE. Medium to Very High Active Single Step Neutralization. Seattle WA. http/www.chemithon.com/press.html.

Surfactants. INFORM, vol. 7, No. 1 (Jan. 1996): pp.10–12.

Kirk–Othmer Detergency. *Encyclopedia of Chemical Technology*. 4$^{th}$ Ed. Vol. 7 (Composite Materials to Detergency) Eds: Kroschwitz, Jacqueline I., Howe–Grant, Mary, John Wiley & Sons New York: pp. 1072–1116.

Rao, Y.K., Sajic, B. Physico–Chemical Properties of Some Salts of Sulfo Methyl Ester Surfactants. 1996. 4$^{th}$ World Surfactants Congress: pp. 382–391.

*Primary Examiner*—Necholus Ogden
(74) *Attorney, Agent, or Firm*—Townsend and Towsend and Crew, LLP

(57) ABSTRACT

A washing composition is disclosed which includes an α-sulfofatty acid ester and a silicate builder to control water hardness while reducing builder deposits on clothing. The composition is free of added inorganic phosphate builders and insoluble zeolite builders, yet provides comparable cleaning performance to detergents containing such builders.

23 Claims, No Drawings

α-SULFOFATTY ACID METHYL ESTER LAUNDRY DETERGENT COMPOSITION WITH REDUCED BUILDER DEPOSITS

BACKGROUND OF THE INVENTION

The present invention generally relates to compositions containing an α-sulfofatty acid ester. More specifically, the invention relates to detergent compositions containing at least one α-sulfofatty acid ester and at least one silicate builder to reduce deposits on materials washed with such detergents.

Detergents have been used for many years to clean clothing and other materials. Detergents originally contained soap derived from animal fats. More recently, surfactants have been included in detergents to enhance their cleaning performance. Typical surfactants include anionic, nonionic and/or cationic surfactants, depending on the desired cleaning properties of the detergent composition.

Anionic surfactants are generally used in laundry detergents due to their improved cleaning performance as well as their ability to reduce hard water buildup. The cleaning performance of laundry detergents containing anionic surfactants can be limited, however, by the hardness of the wash water. In particular, calcium and/or magnesium ions in hard water can interfere with anionic surfactants such as alkyl olefin sulfonates, alkyl sulfates, linear alkyl sulfonates, and linear alkyl benzene sulfonates.

To overcome the deficiencies of such anionic surfactants, builders are often added to detergent compositions. Builders reduce water hardness by ion exchanging or sequestering calcium and/or magnesium ions, thereby preventing such ions from interfering with other components of the detergent composition. Builders may also serve as a source of alkalinity and can prevent the deposition of salts on metal surfaces in washing machines.

Inorganic phosphates, such as alkali phosphates and polyphosphates, are one class of builders. Such phosphates sequester calcium and/or magnesium from water. For example, tripolyphosphates sequester one mole of calcium or magnesium per mole of tripolyphosphate to form calcium or magnesium phosphate or tripolyphosphate complexes. Calcium and magnesium phosphate or tripolyphosphate complexes are relatively stable in water, and thus they reduce the tendency of the divalent cations to interact with other components of the detergent composition. The use of phosphates in laundry detergents has significantly decreased in recent years, however, because such phosphates accelerate bacterial growth and eutrophication of lakes and other bodies of water.

Pyrophosphates have been used as a substitute for alkali metal phosphates and polyphosphates. Like polyphosphates, pyrophosphates sequester calcium or magnesium ions to form calcium or magnesium pyrophosphate complexes. Certain pyrophosphate builders such as dicalcium pyrophosphates, which form under washing conditions, unfortunately can precipitate in water, causing spotting on clothing and build-up on the exposed surfaces of washing machines.

Another alternative to phosphate and pyrophosphate builders are silicates, polysilicates, and phyllosilicates. Such silicates are highly soluble in water and interact with hard water to form calcium and/or magnesium silicate complexes which, while being soluble in hard water, do not deposit on materials during washing. They also have a lower cationic exchange capacity than other builders. Thus, as compared to other builders, larger amounts of such silicates must be added to provide a comparable building action. Indeed, for some surfactants, they are not effective builders under hard water conditions.

Carbonates, such as sodium carbonate, have also been used a substitute for phosphate builders. Although carbonates provide a cost-effective source of alkalinity and reduce water hardness by sequestering calcium ions, carbonates tend to precipitate during washing. Like with pyrophosphates, such precipitation can cause spotting on clothing.

Aluminosilicates and clays have also been used as builders in laundry detergents. In particular, both naturally occurring and synthetic aluminosilicates, such as zeolites, have been added to detergents to add building capacity. Zeolites ion exchange divalent cations, thereby decreasing the hardness of water. Zeolites are typically insoluble in water, however, and therefore detergent compositions containing such zeolites could leave deposits.

SUMMARY OF THE INVENTION

The present invention is a detergent composition exhibiting both a high cleaning performance and an ability to reduce builder deposits. Such detergent compositions are able to achieve both results since they contain a water-soluble builder which controls water hardness while limiting builder precipitation.

The present invention includes a detergent composition comprising at least one silicate builder and at least one ester of the formula:

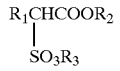

(I)

where $R_1$ is an alkyl group, $R_2$ is an alkyl group, and $R_3$ is hydrogen, a halogen, a metal, or an unsubstituted or substituted ammonium cation. $R_1$ may be a $C_6$ to $C_{24}$ alkyl group including a $C_{12}$, $C_{14}$, $C_{16}$, or $C_{18}$ alkyl group. $R_2$ may be a $C_1$ to $C_8$ alkyl group, including a methyl group. $R_3$ may be a metal, including an alkali metal like sodium. The at least one ester of formula (I) may be a methyl ester sulfonate, such as a $C_{16}$ methyl ester sulfonate, a $C_{18}$ methyl ester sulfonate, or a mixture thereof. The at least one silicate builder can be a silicated salt, non-phosphate silicate salt, wholly or partially crystallite layer-form silicate, phyllosilicate, disilicate, or mixture or combination thereof. The composition may contain at least about 25 wt % of at least one ester of formula (I), including at least about 35 wt % of at least one ester of formula (I). The composition may contain an effective amount of the at least one silicate builder, including about 15 wt % to about 40 wt % or about 20 wt % to about 30 wt %. The composition may contain substantially no inorganic and organic phosphate-containing builder, insoluble aluminosilicate builder, acrylate polymer dispersant, or sequestrant. The composition may contain at least one nonionic surfactant, anionic surfactant, oxidizing agent, biocidal agent, optical brightener, or enzyme, or mixtures or combinations thereof. The composition may be a powder.

The present invention also includes a detergent composition containing substantially no inorganic and organic phosphate-containing builder, insoluble aluminosilicate builder, acrylate polymer dispersant, or sequestrant, yet which contains at least one silicate builder and at least one ester of the formula:

$$R_1CHCOOR_2 \quad (I)$$
$$|$$
$$SO_3R_3$$

where $R_1$ is an alkyl group, $R_2$ is an alkyl group, and $R_3$ is hydrogen, a halogen, a metal, or an unsubstituted or substituted ammonium cation.

The present invention further includes a powdered detergent composition containing substantially no inorganic and organic phosphate-containing builder, insoluble aluminosilicate builder, acrylate polymer dispersant, or sequestrant, yet which contains about 20 wt % to about 30 wt % of at least one silicated salt and at least about 35 wt % of a $C_{16}$ methyl ester sulfonate, a $C_{18}$ methyl ester sulfonate, or mixture thereof.

The present invention also includes a powdered detergent composition consisting essentially of at least one silicate builder and at least one ester of the formula:

$$R_1CHCOOR_2 \quad (I)$$
$$|$$
$$SO_3R_3$$

where $R_1$ is an alkyl group, $R_2$ is an alkyl group, and $R_3$ is hydrogen, a halogen, a metal, or an unsubstituted or substituted ammonium cation.

DETAILED DESCRIPTION OF THE INVENTION

The following description provides specific details, such as materials and proportions, to provide a thorough understanding of the invented detergent composition. The skilled artisan will appreciate, however, that the invention may be practiced without employing these specific details. Indeed, the invention can be practiced in conjunction with manufacturing and processing techniques conventionally used in the detergent industry. Moreover, the processes below describe only steps, rather than a complete process flow, for manufacturing the invented detergent composition.

The detergent compositions of the present invention include at least one ester of the formula:

$$R_1CHCOOR_2 \quad (I)$$
$$|$$
$$SO_3R_3$$

wherein $R_1$ is an alkyl group, $R_2$ is an alkyl group, and $R_3$ is hydrogen, a halogen, a metal, or an unsubstituted or substituted ammonium cation, such as monoethanolamine, diethanolamine, or triethanolamine. Esters of the formula (I), which are also referred to as cc-sulfofatty acid esters, include the esters described in U.S. Pat. No. 5,945,394, the disclosure of which is incorporated herein by reference. Any alkyl group can be used as $R_1$ or $R_2$ depending on the desired characteristics, including the surfactant properties, of that ester. Preferably, $R_1$ is an alkyl group containing 6 to 24 carbon atoms and is more preferably a $C_{12}$, $C_{14}$, $C_{16}$, $C_{18}$ alkyl group, or a mixture thereof. $R_2$ is preferably a $C_1$ to $C_8$ alkyl group or mixture thereof and is more preferably a methyl group. $R_3$ is preferably a metal, such as an alkali metal like sodium.

More preferably, the ester of formula (I) is a salt of formula (II):

$$R_1CHCOOR_2 \quad (II)$$
$$|$$
$$SO_3M$$

wherein $R_1$ is an alkyl group, $R_2$ is an alkyl group, and M is a monovalent metal. Preferably, $R_1$ is an alkyl group containing 6 to 24 carbon atoms, and more preferably a $C_{12}$, $C_{14}$, $C_{16}$, or $C_{18}$ alkyl group or a mixture thereof. $R_2$ is preferably a $C_1$ to $C_4$ alkyl group and is more preferably a methyl group. M is preferably an alkali metal and is more preferably sodium.

The esters of formula (I) can be manufactured by any suitable method known in the art. Suitable methods of manufacturing such esters include those described in, for example, U.S. Pat. Nos. 5,945,394, 5,329,030, 5,382,677, 5,384,422, 4,816,188, and 4,671,900, and International patent application WO-A-91-09009, the disclosures of which are incorporated herein by reference. Such esters can be manufactured using a variety of sources, including beef tallow, palm kernel oil, palm stearin oil, coconut oil, soybean oil, canola oil, cohune oil, palm oil, white grease, cottonseed oil, and mixtures thereof and fractions thereof. Other sources of fatty acids to make such esters include caprylic ($C_8$), capric ($C_{10}$), lauric ($C_{12}$), myristic ($C_{14}$), myristoleic ($C_{14}$), palmitic ($C_{16}$), palmitoleic ($C_{16}$), stearic ($C_{18}$), oleic ($C_{18}$), linoleic ($C_{18}$), linolenic ($C_{18}$), ricinoleic ($C_{18}$), arachidic ($C_{20}$), gadolic ($C_{20}$), behenic ($C_{22}$) and erucic ($C_{22}$) fat acids.

The detergent composition of the present invention also includes at least one silicate builder. One silicate builder that can be employed in the present invention includes silicated salts. The term "silicated salt" means a non-phosphate salt, such as a carbonate, sulfate, alkali metal carbonate, alkali metal sulfate, ammonium carbonate, bicarbonate, sesquicarbonate, or mixtures thereof, that has been treated with any silicate salt. Silicated salts and methods for preparing such salts are disclosed in U.S. Pat. No. 4,973,419, the disclosure of which is incorporated herein by reference.

Other suitable silicate builders of the present invention include non-phosphate silicate salts, including polysilicates and alkali metal silicates. One preferred alkali metal silicate is a sodium silicate such as a hydrous sodium silicate having an $SiO_2$ to $Na_2O$ ratio ranging from about 2.0 to about 2.4, including those sold by PQ Corporation under the trade names BRITESIL® H20, BRITESIL® H24, and BRITESIL® C-24.

Other suitable silicate builders include wholly or partially crystallite layer-form silicates of the formula $Na_2Si_x.O_{2x+1}$ $yH_2O$, where x ranges from about 1.9 to about 4 and y ranges from 0 to about 20. Such silicates are described, for example, in U.S. Pat. No. 5,900,399, the disclosure of which is incorporated here by reference.

Other suitable silicate builders include phyllosilicates or disilicates. Disilicates that can be employed in the present invention include those known in the art, including those having the formula $Na_2O.2SiO_2$ or $Na_2Si_2O_5.yH_2O$ where y is an integer. Preferred disilicates include β-sodium disilicates, such as those described in International patent application WO-A-91-08171, the disclosure of which is incorporated herein by reference. Disilicates sold under the trade names SKS® 6 and SKS® 7 by Hoescht AG and Clariant Corporation can also be employed in the present invention.

The detergent compositions of the present invention contain at least one ester of the formula (I) and at least one silicate builder. Preferably, the detergent compositions contain at least about 25 weight percent of an ester of formula (I). More preferably, the detergent compositions contain at least about 30 weight percent, and even more preferably at least about 35 weight percent, of an ester of formula (I).

The detergent compositions of the present invention preferably contain an effective amount of a silicate builder. An effective amount of the silicate builder is that amount providing sufficient ion exchange capacity or sequestration ability to improve the cleaning performance of the formula (I) ester(s). The detergent compositions preferably contain at least about 15 weight percent silicate builder, more preferably about 15 weight percent to 40 weight percent silicate builder, and even more preferably about 20 weight percent to about 30 weight percent silicate builder.

The detergent compositions of the present invention preferably contain only negligible amounts of phosphate builders. More preferably, the detergent composition contains no measurable amount of phosphate builders and more preferably contains no phosphate builders. The term "phosphate builders" means both inorganic and organic phosphate-containing builders such as alkali metal phosphates, orthophosphates, polyphosphates, tripolyphosphates, pyrophosphates, and polymeric phosphates. The detergent compositions of the present invention may contain other phosphate-containing detergent components that are not builders. For example, phosphate-containing components that provide other functions or beneficial properties can be included in the detergent compositions of the present invention.

The detergent compositions of the present invention preferably contain only negligible amounts of aluminosilicate builders. More preferably, the detergent composition contains no measurable amount of aluminosilicate builders and more preferably contains no aluminosilicate builders. Such aluminosilicate builders include those known in the art, such as those of the formulae (III) and (IV):

$$Na_z[(AlO_2)_z(SiO_2)_y].xH_2O \quad \text{(III)}$$

where z and y are integers greater than 5, x is an integer ranging from 15 to 264, and the molar ratio of z to y ranges from about 1.0 to about 0.5; and $$M_z(zAlO_2.\ ySiO_2) \quad \text{(IV)}$$

where M is sodium, potassium, ammonium, or substituted ammonium, z ranges from about 0.5 to about 2, and y is 1. Examples of such aluminosilicates builders include zeolite NaA, zeolite NaX, zeolite P, zeolite Y, hydrated zeolite 4A, or mixtures thereof.

The detergent compositions of the present invention preferably contain only negligible amounts of acrylate polymer dispersants. More preferably, the detergent compositions contain no measurable amount of acrylate polymer dispersants and more preferably contains no acrylate polymer dispersants. Acrylate polymer dispersants includes any polymer, including co-polymers, of acrylic acid or its esters used as a dispersant, for example, acrylic acid, methacrylic acid, maleic acid, flimaric acid, itaconic acid, and water-soluble salts thereof, such as alkali metal, ammonium, or substituted ammonium salts.

The detergent compositions of the present invention preferably contain only negligible amounts of sequestrants. More preferably, the detergent composition contains no measurable amount of sequestrants and more preferably contains no sequestrants. Such sequestrants include, for example, ethylenediamine tetraacetate (EDTA) and sodium nitrilotriacetate (NTA).

By excluding inorganic phosphate and insoluble aluminosilicate builders, the detergent compositions of the present invention reduce builder deposits and spotting, while providing comparable cleaning performance to detergents containing such builders. Builder deposits can be measured by any suitable method known in the art, including the scale buildup study procedure for heavy-duty laundry detergents. Another method for measuring scale buildup is to wash standardized testing swatches (available from Scientific Services S/D, Inc., New York or Test Fabrics Inc., Pennsylvania) five times with hard water then drying the swatches after each wash. The hard water contains 200–300 ppm $CaCO_3$ and has a Ca/Mg ratio of about 3:2. The ash content is then measured according to ASTM standard test method for total ash in leather (D 2617–69).

The detergent compositions of the present invention can also contain at least one other detergent component or additive. Such components or additives include surfactants, including both nonionic and anionic surfactants, oxidizing agents, biocidal agents, optical brighteners, and enzymes, as well as other additives known in the art like activators, catalysts, thickeners, stabilizers, fragrances, soil suspending agents, fillers, dyes, water, inert ingredients, and combinations thereof.

At least one nonionic surfactant can optionally be added to the detergent composition of the present invention. Suitable nonionic surfactants include those containing an organic hydrophobic group and a hydrophilic group that is a reaction product of a solubilizing group (such as a carboxylate, hydroxyl, amido or amino group) with ethylene oxide, propylene oxide, or a polyhydration product thereof (such as polyethylene glycol). Such nonionic surfactants include, for example, polyoxyalkylene alkyl ethers, polyoxyalkylene alkylphenyl ethers, polyoxyalkylene sorbitan fatty acid esters, polyoxyalkylene sorbitol fatty acid esters, polyalkylene glycol fatty acid esters, alkyl polyalkylene glycol fatty acid esters, polyoxyethylene polyoxypropylene alkyl ethers, polyoxyalkylene castor oils, polyoxyalkylene alkylamines, glycerol fatty acid esters, polyoxyalkylene fatty acid alkanolamides, alkylglucosamides, alkylglucosides, and alkylamine oxides. Preferably, the nonionic surfactant is an alkoxylated fatty acid alkanolamide having linear or branched alkylene adducts with an average molar number of about 2 to about 15. Other suitable surfactants include those disclosed in U.S. Pat. Nos. 5,133,892, 5,358,655, 5,783,540, and 4,219,435, the disclosures of which are incorporated herein by reference.

At least one anionic surfactant can optionally be added to the detergent composition of the present invention. Examples of suitable anionic surfactants include alkylbenzenesulfonates, alkyl or alkenyl ether sulfates, alkyl or alkenyl sulfates, α-olefinsulfonates, alkyl or alkenyl ether carboxylates, amino acid-type surfactants, and N-acyl amino acid-type surfactants.

At least one oxidizing agent can optionally be added to the detergent composition of the present invention. Any suitable oxidizing agent, such as non-chlorine containing oxidizing agents, can be included in the detergent composition of the present invention. Suitable non-chlorine oxidizing agents include oxygen bleaches known in the art, such as perborates, percarbonates, persulfates, dipersulfates, sodium carbonate peroxyhydrate, sodium pyrophosphate peroxyhydrate, urea peroxyhydrate, and sodium peroxide. Other suitable non-chlorine oxidizing agents include bleach activators, such as tetraacetyl ethylene diamine (TAED), sodium benzoyl oxybenzene sulfonate, choline sulfophenyl carbonate, and those described in U.S. Pat. Nos. 4,915,854 and 4,412,934, the disclosures of which are incorporated herein by reference. Other suitable non-chlorine oxidizing agents include a catalyst such as manganese or other transition metal in combination with such oxygen bleaches, may also optionally be included.

Other suitable oxidizing agents include percarboxylic acid bleaching agents and salts thereof, such as magnesium monoperoxyphthalate hexahydrate and the magnesium salts of meta-chloro perbenzoic acid, 4-nonylamino-4-oxoperoxybutyric acid and diperoxydodecanedioic acid, Other oxidizing agents include those described in U.S. Pat. Nos. 4,483,781, 4,634,551, and 4,412,934, as well as European Patent Application No. 0,133,354, the disclosures of which are incorporated herein by reference herein.

Other suitable oxidizing agents include non-oxygen containing oxidizing agents, such as photoactivated bleaching agents. Suitable photoactivated bleaching agents include sulfonated zinc and metal phthalocyanines like aluminum and zinc phthalocyanines. Other suitable photoactivated bleaching agents are described in U.S. Pat. No. 4,033,718, the disclosure of which is incorporated herein by reference.

At least one biocidal agent can optionally be added to the detergent composition of the present invention. Suitable biocidal agents include TAED, TAED combined with a persalt, Triclosan, and quaternary ammonium compounds such as alkyl dimethyl ammonium chlorides, alkyl trimethyl ammonium chlorides, dialkyl dimethyl ammonium chlorides, benzalkonium chloride, parachlorometaxylene, and alkyl dimethyl benzyl ammonium chloride. Other biocidal agents include those sold under the trade names Bardac and Barquat by the Lonza Group and those sold under the trade name BTC by the Stepan Company.

At least one optical brightener may be optionally added to the detergent compositions of the present invention. Suitable optical brighteners include stilbenes such as TINOPAL AMS sold by Ciba Geigy, distyrylbiphenyl derivatives such as TINOPAL CBS-X sold by Ciba Geigy, stilbene/naphthotriazole blends such as TINOPAL RA-16 sold by Ciba Geigy, oxazole derivatives, and coumarin brighteners.

At least one enzyme can optionally be added to the detergent composition of the present invention. Suitable enzymes include any of those known in the art, such as proteases. One preferred protease, sold under the trade name SAVINASE™ by NOVO Industries A/S, is a subtillase from Bacillus lentus. Other suitable enzymes include amylases, lipases, and cellulases such as Termamyl®, Lipolase® or Carezyme® sold by Novo Industries A/S.

The detergent compositions of the present invention can be manufactured in the following manner. First, the esters of formula (I) can be manufactured in a powder form, as described above, by the methods described in U.S. Pat. Nos. 5,329,030, 5,382,677, 5,384,422, 4,816,188, and 4,671,900, and International patent application WO-A-91-09009. Next, the silicate builder(s) is then manufactured by any suitable method known in the art depending on the silicate builder selected. For example, a powdered silicated soda ash can be manufactured by silicating soda ash in a spray drying operation or in an agglomerator. The powdered ester of formula (I) and powdered silicate builder are then mixed together to manufacture the detergent composition of the present invention. The various additives and additional detergent components can either be added while the ester and the silicate builder are being mixed or post-added after these two components have been mixed.

EXAMPLES

The following non-limiting examples illustrate detergent compositions according to the present invention. Unless otherwise indicated, the amounts of the various detergent components are listed in weight percentages.

Example 1

The following two samples, samples 1 and 2, of detergent formulations were manufactured.

| Sample 1 | | Sample 2 | |
|---|---|---|---|
| methyl ester sulfonate ($C_{16}$—$C_{18}$) | 25 | methyl ester sulfonate ($C_{16}$—$C_{18}$) | 25 |
| ethoxylated fatty acid amide (average ethoxylation - about 5 mole/mole) | 5 | ethoxylated fatty acid amide (average ethoxylation - about 5 mole/mole) | 10 |
| BRITESIL C-24 | 30 | 1% polyacrylate silicated soda ash | 63 |
| 1% polyacrylate silicated soda ash | 38 | Perborate | 1 |
| Perborate | 1 | Savinase | 1 |
| Savinase | 1 | | |

The samples were tested at a water temperature of 100° F., a tergotometer speed of 100 rpm, and a water hardness of 150 ppm and compared with a commercially-available, zeolite-containing detergent formulation (the "prior art formulation"). As seen from the following results, the samples provide comparable cleaning performance when compared with the prior art formulation.

| | Prior Art Formulation | Sample 1 | Sample 2 |
|---|---|---|---|
| Percent Detergency: | | | |
| Cup Usage | 0.40 | 0.40 | 0.40 |
| Bulk Density | 0.630 | 0.630 | 0.630 |
| Clay C/P | 82.9 | 79.0 | 77.8 |
| Sebum C/P | 84.1 | 83.6 | 80.5 |
| Clay Cot | 60.4 | 59.1 | 58.5 |
| Sebum Cot | 62.2 | 58.6 | 59.7 |
| EMPA 116 | 48.9 | 46.6 | 46.3 |
| EMPA 112 | 30.5 | 45.0 | 40.7 |
| Avg. | 61.5 | 62.0 | 60.6 |
| W/O EMPAs | 72.4 | 70.1 | 69.1 |
| Percent Anti-Redeposition: | | | |
| Cup Usage | 0.40 | 0.40 | 0.40 |
| Clay C/P | 99.2 | 99.1 | 99.6 |
| Sebum C/P | 99.2 | 99.1 | 99.6 |
| Clay Cot | 98.2 | 98.5 | 98.5 |
| Sebum Cot | 98.2 | 98.5 | 98.5 |
| EMPA 116 | 96.8 | 96.7 | 95.6 |
| EMPA 112 | 96.8 | 96.7 | 95.6 |
| Avg. | 98.1 | 98.1 | 97.9 |
| W/O EMPAs | 98.7 | 98.8 | 99.1 |

Example 2

The following two samples, samples 3 and 4, of detergent formulations were manufactured.

| Sample 3 | | Sample 4 | |
|---|---|---|---|
| methyl ester sulfonate ($C_{16}$—$C_{18}$) (from beef tallow) | 35 | methyl ester sulfonate ($C_{16}$—$C_{18}$) (from beef tallow) | 35 |
| ethoxylated fatty acid amide (average ethoxylation - | 2 | ethoxylated fatty acid amide (average ethoxylation - | 2 |

-continued

| Sample 3 | | Sample 4 | |
|---|---|---|---|
| 5 mole/mole) (from beef tallow) | | 5 mole/mole) (from beef tallow) | |
| BRITESIL 2.4 | 30 | BRITESIL 2.4 | 30 |
| 1% polyacrylate silicated soda ash (no active) | 31 | silicated soda ash | 31 |
| Savinase | 1 | Savinase | 1 |
| Perborate | 1 | perborate | 1 |

The samples were tested at a water temperature of 100° F., a tergotometer speed of 100 rpm, and a water hardness of 150 ppm and then compared the prior art formulation. As seen from the following results, the samples containing silicated soda ash as a substitute for polyacrylate provided comparable cleaning performance to the polyacrylate-containing samples and to the prior art formulation.

| | Prior Art Formulation | Sample 3 | Sample 4 |
|---|---|---|---|
| Percent Detergency: | | | |
| Cup Usage | 0.40 | 0.40 | 0.40 |
| Bulk Density | 0.630 | 0.630 | 0.630 |
| Clay C/P | 82.4 | 81.2 | 83.9 |
| Sebum C/P | 86.1 | 85.6 | 84.8 |
| Clay Cot | 61.5 | 61.9 | 59.8 |
| Sebum Cot | 63.1 | 56.6 | 59.0 |
| EMPA 116 | 49.3 | 44.8 | 47.9 |
| EMPA 112 | 45.8 | 42.9 | 42.6 |
| Avg. | 64.7 | 62.2 | 63.0 |
| W/O EMPAs | 73.3 | 71.3 | 71.9 |
| Percent Anti-Redeposition: | | | |
| Cup Usage | 0.40 | 0.40 | 0.40 |
| Clay C/P | 100.4 | 101.4 | 101.7 |
| Sebum C/P | 100.4 | 101.4 | 101.7 |
| Clay Cot | 100.4 | 100.4 | 100.6 |
| Sebum Cot | 100.4 | 100.4 | 100.6 |
| EMPA 116 | 99.7 | 99.9 | 99.8 |
| EMPA 112 | 99.7 | 99.9 | 99.8 |
| Avg. | 100.2 | 100.6 | 100.7 |
| W/O EMPAs | 100.4 | 100.9 | 101.1 |

Example 3

The following detergent formulations, samples 5 and 6, were manufactured.

| Sample 5 | | Sample 6 | |
|---|---|---|---|
| methyl ester sulfonate ($C_{16}$—$C_{18}$) | 35 | methyl ester sulfonate ($C_{16}$—$C_{18}$) | 35 |
| ethoxylated fatty acid amide (average ethoxylation - about 5 mole/mole) | 2 | ethoxylated fatty acid amide (average ethoxylation - about 5 mole/mole) | 2 |
| Savinase | 1 | Savinase | 1 |
| perborate | 1 | perborate | 1 |
| silicated soda ash | 61 | silicated soda ash | 61 |

The samples were tested at a water temperature of 100° F., a tergotometer speed of 100 rpm, and a water hardness of 150 ppm and then compared with the prior art formulation. As seen from the following results, a detergent composition containing $C_{16}$-$C_{18}$ methyl ester sulfonate and silicated soda ash provided comparable cleaning performance to the prior art formulation.

| | Prior Art Formulation | Sample 5 | Sample 6 |
|---|---|---|---|
| Precent Detergency: | | | |
| Cup Usage | 0.40 | 0.40 | 0.40 |
| Bulk Density | 0.630 | 0.630 | 0.630 |
| Clay C/P | 78.1 | 75.8 | 78.4 |
| Sebum C/P | 81.5 | 79.9 | 79.2 |
| Clay Cot | 59.4 | 53.9 | 54.2 |
| Sebum Cot | 54.8 | 52.6 | 53.6 |
| EMPA 116 | 47.0 | 46.5 | 45.9 |
| EMPA 112 | 44.2 | 42.7 | 43.3 |
| Avg. | 60.8 | 58.6 | 59.1 |
| W/O EMPAs | 68.4 | 65.6 | 66.3 |
| Percent Anti-Redeposition: | | | |
| Cup Usage | 0.40 | 0.40 | 0.40 |
| Clay C/P | 98.7 | 99.1 | 99.4 |
| Sebum C/P | 98.7 | 99.1 | 99.4 |
| Clay Cot | 97.9 | 97.5 | 97.9 |
| Sebum Cot | 97.9 | 97.5 | 97.9 |
| EMPA 116 | 97.0 | 96.5 | 97.2 |
| EMPA 112 | 97.0 | 96.5 | 97.2 |
| Avg. | 97.9 | 97.7 | 98.2 |
| W/O EMPAs | 98.3 | 98.3 | 98.6 |

Example 4

The following detergent formulation, sample 7, was manufactured.

| Sample 7 | |
|---|---|
| Britesil Base | 30 |
| methyl ester sulfonate ($C_{16}$—$C_{18}$) | 30 |
| silicated soda ash | 38 |
| perborate | 1 |
| Savinase | 1 |

The Britesil Base had the following composition.

| Britesil Base | |
|---|---|
| BRITESIL C24 | 74 |
| soda ash 100 | 10 |
| N-120 (nonionic surfactant) | 16 |
| Minor amount of sodium silicate | |

The samples were tested at a water temperature of 100° F., a tergotometer speed of 100 rpm, and a water hardness of 150 ppm and then compared to the prior art formulation. As seen from the following results, a detergent composition containing a $C_{16}$–$C_{18}$ methyl ester sulfonate from beef tallow and a combination of silicated soda ash and Britesil Base provide comparable cleaning performance to the prior art formulation.

| | Prior Art Formulation | Sample 7 |
|---|---|---|
| Percent Detergency: | | |
| Cup Usage | 0.40 | 0.40 |
| Bulk Density | 0.630 | 0.630 |
| Clay C/P | 77.6 | 72.3 |
| Sebum C/P | 79.8 | 76.3 |
| Clay Cot | 56.8 | 56.0 |
| Sebum Cot | 48.7 | 48.1 |
| EMPA 116 | 46.6 | 41.9 |
| EMPA 112 | 31.4 | 32.9 |
| Avg. | 56.8 | 54.6 |
| W/O EMPAs | 65.7 | 63.2 |
| Percent Anti-Redeposition: | | |
| Cup Usage | 0.40 | 0.40 |
| Clay C/P | 99.0 | 99.0 |
| Sebum C/P | 99.0 | 99.0 |
| Clay Cot | 98.5 | 98.4 |
| Sebum Cot | 98.5 | 98.4 |
| EMPA 116 | 97.1 | 96.9 |
| EMPA 112 | 97.1 | 96.9 |
| Avg. | 98.2 | 98.1 |
| W/O EMPAs | 98.7 | 98.7 |

Example 5

The following comparative samples, samples 8 and 9, were manufactured.

| Sample 8 | | Sample 9 | |
|---|---|---|---|
| Sodium carbonate | 77.49 | Sodium carbonate | 77.19 |
| Sodium silicate | 14.0 | Sodium silicate | 14.0 |
| Surfonic N120 | 8.0 | NaLAS | 8.3 |
| Sodium carboxymethyl-cellulose | 0.5 | Sodium carboxymethyl-cellulose | 0.5 |
| Optical Brightener | 0.01 | Optical Brightener | 0.01 |

For samples 1–9 and the prior art formulation, the scale buildup was measured according to the following procedure.

1. Glass slides were cleaned in acetone, placed on pieces of filter paper, and then dried at 100° F. for 1 hour. After cooling, the slides were weighed.

2. The slides were then placed in the tergotometer which contained 1000 ml of water with the desired conditions (temperature: 100° F.; water hardness: 300 ppm $CaCO_3$; detergent concentration: 1.109 g/L). Each detergent sample was added to tergotometer and the bucket was agitated for ten (10) minutes.

3. After agitating, the slides were removed, rinsed in distilled water, rinsed again for five minutes in the tergotometer which contained 900 ml fresh water of the desired conditions detailed in step (2) above and 100 ml of the water used in step (2).

4. Steps (2) and (3) were repeated four times.

5. The amount of builder deposition on the glass slides was then measured and reported below as mg of buildup per dm2 of the slide.

| Sample | Scale Buildup (mg/dm$^2$) |
|---|---|
| Prior Art Formulation | 0.8 |
| Sample 1 | 0.4 |
| Sample 2 | 0.7 |
| Sample 3 | 0.7 |
| Sample 4 | 0.8 |
| Sample 5 | 5.4 |
| Sample 6 | 13.0 |
| Sample 7 | 1.1 |
| Sample 8 | 27.1 |
| Sample 9 | 41.8 |

As seen from these results, all inventive samples 1–7 contained less scale buildup than the comparative samples 8 and 9. Inventive samples 2, 3, 4, and 7 contained about the same scale buildup as the prior art formulation. Inventive sample 1 contained less scale buildup than the prior art formulation Having described in detail the present invention, the invention defined by the appended claims is not limited by particular details set forth in the above description, as many apparent variations thereof are possible without departing from the spirit or scope thereof.

We claim:

1. A composition, comprising:

about 15 wt % to about 40 wt % of at least one silicate builder; and at least one α-sulfofatty acid ester of the formula:

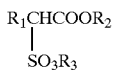

(I)

wherein $R_1$ is an alkyl group, $R_2$ is a methyl group, and $R_3$ is hydrogen, a halogen, a metal, or an unsubstituted or substituted ammonium cation; and containing substantially no inorganic and organic phosphate-containing builder, insoluble aluminosilicate builder, acrylate polymer dispersant, or sequestrant;

whereby builder deposits on clothing washed with the composition are reduced.

2. The composition of claim 1, wherein $R_1$ is a $C_6$ to $C_{24}$ alkyl group, and $R_3$ is a metal.

3. The composition of claim 2 wherein $R_1$ is a $C_{12}$, $C_{14}$, $C_{16}$, or $C_{18}$ alkl group, or mixture thereof, and $R_3$ is an alkali metal.

4. The composition of claim 1, wherein the α-sulfofatty acid ester is a $C_{16}$ methyl ester sulfonate, a $C_{18}$ methyl ester sulfonate, or a mixture thereof.

5. The composition of claim 1, wherein the α-sulfofatty acid ester contains a fatty acid ester having an average of about 16 to 18 carbon atoms.

6. The composition of claim 1, wherein the at least one silicate builder is a silicated salt, non-phosphate silicate salt, wholly or partially crystallite layer-form silicate, phyllosilicate, disilicate, or mixture or combination thereof.

7. The composition of claim 6, comprising at least one silicate builder is a silicated salt.

8. The composition of claim 1, comprising at least about 25 wt % of at east one α-sulfofatty acid ester of formula (I).

9. The composition of claim 8, comprising at least about 35 wt % of at least one α-sulfofatty acid ester of formula (I).

10. The composition of claim 1, comprising about 20 wt % to about 30 wt % of the at least one silicate builder.

11. The composition of claim 1, further comprising at least one nonionic surfactant, anionic surfactant, oxidizing agent, biocidal agent, optical brightener, or enzyme, or mixtures or combinations thereof.

12. The composition of claim 1, wherein the composition is a powder.

13. A detergent composition, comprising:

at least about 15 wt % to about 40 wt % of at least one silicate builder; and at least about 25 wt % of at least one α-sulfofatty acid ester of the formula:

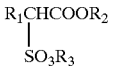

(I)

wherein $R_1$ is an alkyl group, $R_2$ is a methyl group, and $R_3$ is hydrogen, a halogen, a metal, or an unsubstituted or substituted ammonium cation, which is substantially free of inorganic and organic phosphate-containing builder.

14. The composition of claim 13, wherein the at least one α-sulfofatty acid ester of the formula (I) is a $C_{16}$ methyl ester sulfonate, a $C_{18}$ methyl ester sulfonate, or a mixture thereof.

15. The composition of claim 13, wherein the at least one silicate builder is a silicated salt.

16. The composition of claim 13, comprising at least about 35 wt % of the at least one α-sulfofatty acid ester of formula (I).

17. The composition of claim 13, comprising about 20 wt % to about 30 wt % of the at least one silicate builder.

18. The composition of claim 13, further comprising at least one nonionic surfactant, anionic surfactant, oxidizing agent, biocidal agent, optical brightener, or mixtures or combinations thereof.

19. A powdered detergent composition, comprising:

a about 20 wt % to about 30 wt % of at least one silicate builder; and at least about 35 wt % of at least one α-sulfofatty acid ester of the formula:

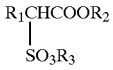

(I)

wherein $R_1$ is an alkyl group, $R_2$ is an alkyl group, and $R_3$ is hydrogen, a halogen, a metal, or an unsubstituted or substituted ammonium cation; and containing substantially no inorganic or organic phosphate-containing builder, insoluble aluminosilicate builder, sequestrant, or acrylate polymer dispersant.

20. The composition of claim 19, wherein the at least one α-sulfofatty acid ester of the formula (I) is a $C_{16}$ methyl ester sulfonate, a $C_{18}$ methyl ester sulfonate, or a mixture thereof.

21. The composition of claim 19, wherein the at least one silicate builder is a silicated salt.

22. A detergent composition containing substantially no inorganic and organic phosphate-containing builder, insoluble aluminosilicate builder, acrylate polymer dispersant, or sequestrant, the composition comprising:

at least about 15 weight percent at least one silicate builder; and at least one α-sulfofatty acid ester of the formula:

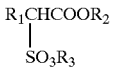

(I)

wherein $R_1$ is an alkyl group, $R_2$ is a methyl group, and $R_3$ is hydrogen, a halogen, a metal, or an unsubstituted or substituted ammonium cation.

23. A powdered detergent composition containing substantially no inorganic and organic phosphate-containing builder, insoluble aluminosilicate builder, acrylate polymer dispersant, or sequestrant, the composition comprising:

about 20 wt % to about 30 wt % of at least one silicated salt; and at least about 35 wt % of a $C_{16}$ methyl ester sulfonate, a $C_{18}$ methyl ester sulfonate, or a mixture thereof.

* * * * *

UNITED STATES PATENT AND TRADEMARK OFFICE

CERTIFICATE OF CORRECTION

PATENT NO. : 6,407,050 B1 
DATED : June 18, 2002
INVENTOR(S) : Paul Danton Huish and Laurie Jensen It is certified that error appears in the above-identified patent and that said Letters Patent is hereby corrected as shown below:

Column 13,
Line 24, after "builder" please insert -- , insoluble aluminasilicate builder, acrylate polymer dispersant or sequestrant --

Signed and Sealed this

Twenty-ninth Day of April, 2003

JAMES E. ROGAN
*Director of the United States Patent and Trademark Office*